US007286643B2

(12) United States Patent
Hebert et al.

(10) Patent No.: US 7,286,643 B2
(45) Date of Patent: Oct. 23, 2007

(54) X-RAY TUBE TARGET BALANCING FEATURES

(75) Inventors: Michael Scott Hebert, Muskego, WI (US); Gregory A. Steinlage, Milwaukee, WI (US); Ryan Paul August, Waukesha, WI (US)

(73) Assignee: General Electric Company, Schenectady, NY (US)

( * ) Notice: Subject to any disclaimer, the term of this patent is extended or adjusted under 35 U.S.C. 154(b) by 270 days.

(21) Appl. No.: 10/707,601

(22) Filed: Dec. 23, 2003

(65) Prior Publication Data

US 2005/0135561 A1 Jun. 23, 2005

(51) Int. Cl.
*H01J 35/10* (2006.01)

(52) U.S. Cl. ..... 378/125; 378/144

(58) Field of Classification Search ..... 378/144, 378/125; 464/180

See application file for complete search history.

(56) References Cited

U.S. PATENT DOCUMENTS

| | | | | |
|---|---|---|---|---|
| 4,073,426 | A | 2/1978 | Devine, Jr. | |
| 4,189,658 | A * | 2/1980 | Schleinkofer | 378/144 |
| 4,212,082 | A | 7/1980 | Barber et al. | |
| 4,276,493 | A | 6/1981 | Srinivasa et al. | |
| RE31,369 | E | 9/1983 | Devine, Jr. | |
| 4,413,355 | A * | 11/1983 | Matsumoto | 378/127 |
| 4,481,655 | A | 11/1984 | Annis et al. | |
| 4,802,196 | A | 1/1989 | Tiearney, Jr. et al. | |
| 4,842,485 | A * | 6/1989 | Barber | 416/144 |
| 4,972,449 | A | 11/1990 | Upadhya et al. | |
| 4,978,051 | A | 12/1990 | Tiearney, Jr. et al. | |
| 5,148,463 | A | 9/1992 | Woodruff et al. | |
| 5,159,619 | A | 10/1992 | Benz et al. | |
| 6,198,805 | B1 | 3/2001 | Jambunathan et al. | |
| 6,256,376 | B1 | 7/2001 | Benz et al. | |
| 6,289,080 | B1 | 9/2001 | Hasz et al. | |
| 6,341,600 | B1 * | 1/2002 | Wakita | 125/13.01 |
| 6,390,876 | B2 | 5/2002 | Benz et al. | |
| 6,449,000 | B1 * | 9/2002 | Suzuki | 347/260 |
| 6,463,125 | B1 | 10/2002 | Minas et al. | |
| 6,477,916 | B2 * | 11/2002 | Knorowski et al. | 416/144 |
| 6,481,969 | B2 * | 11/2002 | Berry et al. | 416/145 |
| 6,584,172 | B2 | 6/2003 | Tiearney et al. | |
| 2001/0005103 | A1 * | 6/2001 | Shinohara | 310/51 |
| 2002/0020315 | A1 * | 2/2002 | Siebolds et al. | 101/216 |
| 2002/0191749 | A1 * | 12/2002 | Hansen et al. | 378/144 |

FOREIGN PATENT DOCUMENTS

JP 10221631 A * 8/1998

* cited by examiner

*Primary Examiner*—Chih-Cheng G Kao
(74) *Attorney, Agent, or Firm*—Pete Vogel, Esq.

(57) ABSTRACT

An x-ray assembly is provided comprising a target shaft and an x-ray target element mounted to the target shaft. A circumferential feature is formed in the x-ray target element. At least one weight element is adapted to be securable in a plurality of positions within the circumferential feature such that the x-ray target element can be balanced around the target shaft.

3 Claims, 2 Drawing Sheets

X-RAY TUBE TARGET BALANCING FEATURES

BACKGROUND OF INVENTION

The present invention relates generally to an x-ray tube assembly, and, more particularly to an x-ray tube target assembly with improved balancing characteristics.

X-ray tubes are well known and widely utilized in a variety of medical imaging fields, medical therapy fields, and material testing and analysis industries. They are commonly comprised of both an anode assembly and a cathode assembly. X-rays are produced when electrons are released in a vacuum with the tube, accelerated and then abruptly stopped. The electrons are released from a heated filament. A high voltage between the anode and the cathode accelerates the electrons and causes them to impinge on the anode. The anode is also referred to as the target since the electrons impact the anode at the focal spot.

In order to dissipate the heat generated at the focal spot, X-ray tubes often incorporate a rotating anode structure. The anode in these arrangements commonly comprises a rotating disc so that the electron beam constantly strikes a different point on the target surface. In order to handle the considerably heat generated by even transient focal spots, present x-ray tube target assemblies are commonly rotated at high rotational speeds. As these speeds increase it becomes more and more critical to have the rotating target assembly properly balanced around its rotational axis. Improper balance can result in unacceptable operational stresses on the target assembly and surrounding structures. Unbalanced assemblies can further introduce chatter and may impart noise into the x-ray tube assembly. In addition, proper balance can effect image quality and bearing wear.

Current techniques for insuring proper balance in the x-ray tube target assembly commonly are comprised for material finishing techniques performed on the finished x-ray target assembly. These techniques use simple material removal operations. Although simple, the use of this material processing technique can lead to unacceptable results. Since existing techniques are performed on finished products, and error in material removal can result in a scrap product. This in turn adds to overall cost increases and delays in manufacturing. Additionally, the removal of material on a finished product can results in the production of particles that may not be all removed after balancing. If all of the resultant particles are not removed they may result in a reduction in high voltage stability of the x-ray tube assembly. Finally, the use of material removal as a basis for balancing the target assembly can result in excessive material removal, which in turn can result in stress problems for the x-ray target assembly during operation. There is, therefore, considerable room for improvement over material processing balancing techniques.

It would, however, be highly desirable to have an x-ray target assembly that could be easily balanced without requiring material removal from the finished product. Similarly, it would be highly desirable to have an x-ray target assembly with balancing features that could be nondestructively modified to balance the x-ray target.

SUMMARY OF INVENTION

An x-ray assembly is provided comprising a target shaft and an x-ray target element mounted to the target shaft. A circumferential feature is formed in the x-ray target element. At least one weight element is adapted to be securable in a plurality of positions within the circumferential feature such that the x-ray target element can be balanced around the target shaft.

Other features of the present invention will become apparent when viewed in light of the detailed description of the preferred embodiment when taken in conjunction with the attached drawings and appended claims.

DETAILED DESCRIPTION

Figure 1:
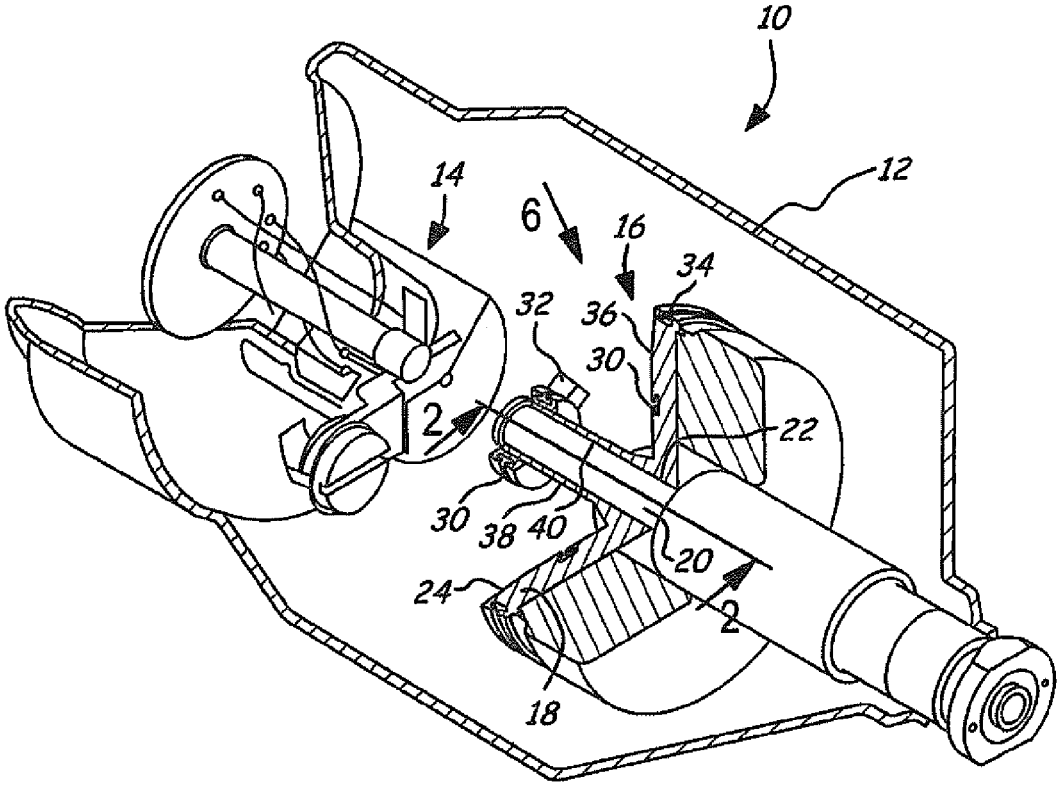
FIG. 1 is an x-ray tube assembly in the present invention.

Referring now to FIG. 1, which is an illustration of an x-ray tube assembly 10 in accordance with the present invention. Although a specific x-ray tube assembly 10 is illustrated, it should be understood that the present invention is contemplated to be useful in a wide variety of x-ray tube assemblies. The x-ray tube assembly 10 includes an x-ray tube housing 12. Within the x-ray tube housing 12 resides a cathode 14. The cathode 14, when charged with an electric current, emits electrons. This electrons travel within the x-ray tube assembly 10 until they impact the anode/x-ray tube target assembly 16. Upon impacting the x-ray tube target assembly 16, the electrons generate x-rays. Such x-ray tube operation is well known in the art.

It is also known, however, that excessive heat can generate in the x-ray tube target element 18 if the electrons continuously impact a single spot. The target assembly 16 therefore includes a target shaft 20 positioned in and in communication with the target bore 22 of the target disc element 18. In this fashion, the target shaft 20 can be utilized to spin the x-ray target element 18 such that the electron stream from the cathode 14 continuously impacts different places on the impact surface 24 of the target disc element 18. It is known that high-speed rotation of the x-ray target element 18 by the target shaft 20 generates considerable momentum, which can be affected by any imbalances in the target assembly 16. Numerous machining techniques have been used to machine the x-ray target element 18 in order to achieve a balanced target assembly 16 or alter the x-ray. These prior techniques, however, carry with them disadvantages.

The present invention provides an improved methodology for balancing the target assembly 16 through the use of a feature, such as a circumferential feature 30 formed on the x-ray target element 18. The circumferential feature 30 works in combination with at least one weight element 32 to provide a balancing means for the target assembly 16. The weight element 32 is adapted to be securable in a plurality of locations within or upon the circumferential feature 30 such that the target assembly 16 can be balanced. Through the use of weight elements 32 with varying weights and modifications of their positions along the circumferential feature 30, precise adjustment of the target assembly 16 balance can be achieved without undesirable machining processes to the assembled target element 18.

It is contemplated that the circumferential feature 30 may be located in a variety of positions on the x-ray target element 18 and may be formed in a variety of configurations. In addition, the circumferential feature 30 may be formed on a plurality of differing surfaces of the x-ray target element 18 in order to provide a broader range of balancing options. Although a wide range of positions are possible, it is contemplated that the circumferential feature 30 may be formed on the perimeter surface 34, the x-ray facing surface 36, or the central neck portion 38 of the x-ray target element 18. The central neck portion 38 comprises a portion of the x-ray target element 18 positioned adjacent the x-ray inner target diameter 40 that extends away from the x-ray facing surface 36 towards the cathode assembly 14. It should be noted that through the use of multiple locations from the central neck portion 38 outward toward the perimeter surface 34 the effect on balancing of a given weight element 32 can be either minimized or maximized respectively.

Figure 3:
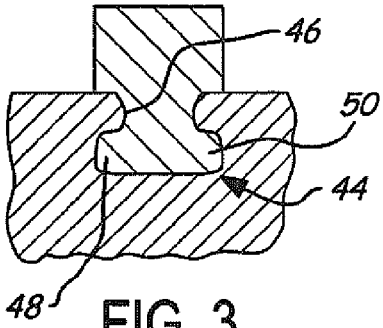
FIG. 3 is a detailed illustration of a weight element and a circumferential securing elbow slot for use in the present invention, the circumferential securing elbow slot formed as a t-shaped slot.
Figure 4:
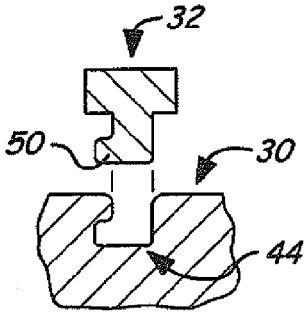
FIG. 4 is a detailed illustration of a weight element and a circumferential securing elbow slot for use in the present invention, the circumferential securing elbow slot formed as a l-shaped slot.
Figure 6:
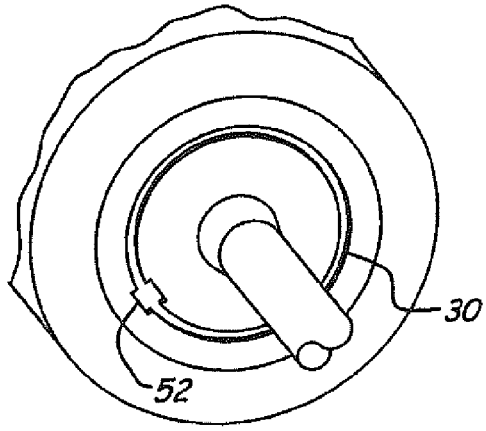
FIG. 6 is detailed illustration of a circumferential slot for use in the present invention, the circumferential slot illustrating an entry port.
Figure 5:
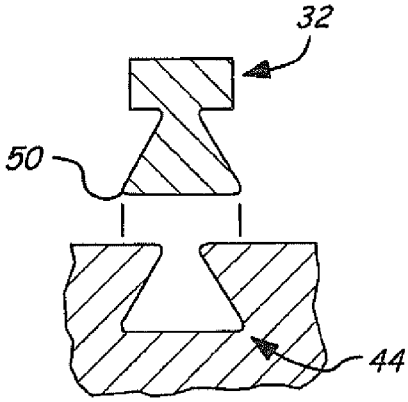
FIG. 5 is a detailed illustration of a weight element and a circumferential securing elbow slot for use in the present invention, the circumferential securing elbow slot formed as a triangular shaped slot.
Figure 7:
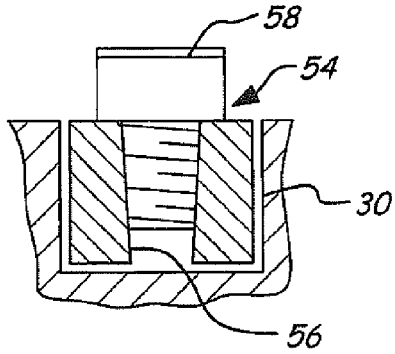
FIG. 7 is detailed illustration of an expandable weight assembly for use in the present invention.

Although a variety of circumferential features 32 are contemplated, one embodiment contemplates the use of a circumferential groove or slot 42 formed in the x-ray target element 18. The circumferential groove 42 can be formed as a simple groove or maybe formed as a circumferential securing elbow slot (see FIGS. 2-5). The circumferential securing elbow slot 44 includes an upper slot opening 46 and at least one internal elbow arm 48. This allows a weight element 32 having a securing elbow 50 adapted to fit within the circumferential securing elbow slot 44 to be locked within the internal elbow arm 48. It is contemplated that the weight element 32 can be formed with a single securing elbow 50 as in FIG. 4 or with two securing elbows 50 to form a t-shaped weight. Similarly, the circumferential securing elbow slot 44 can be formed as a t-shaped slot (FIG. 3), an l-shaped slot (FIG. 4), a triangular slot (FIG. 5), or a host of other securing shapes. It should be understood that the weight element can be placed within the slot 44 in a variety of fashions. In one embodiment, the weight element 32 can be placed within the elbow slot 44 and rotated to secure it. In another embodiment, an entry port 52 can be formed in the circumferential securing elbow slot 44 to allow the adapted weight elements 32 entry (see FIG. 6). In still another embodiment, the weight element 32 can be comprised of an expandable weight assembly 54 having an expansion bore 56 and an expansion screw 58 (see FIG. 7). After placement within the circumferential slot 42, the expansion screw 58 can be turned to lock the expandable weight assembly 54 in the slot 42. Finally, the present invention contemplates other weigh attachment methodologies such as bonding, welding, or brazing.

Figure 2:
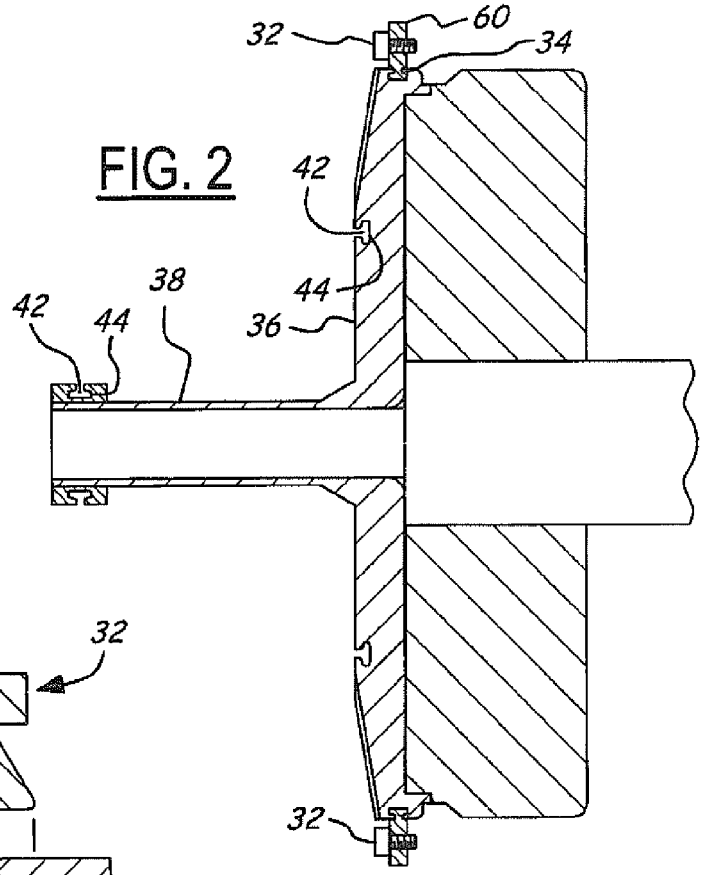
FIG. 2 a cross-sectional illustration of an alternate x-ray target for use in the x-ray tube assembly illustrated in FIG. 1.
Figure 8:
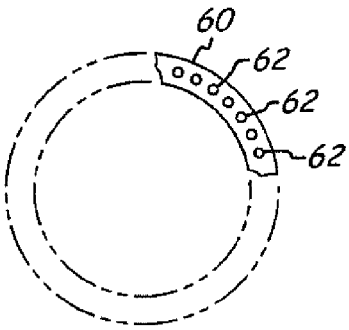
FIG. 8 is a detailed illustration of the flange element illustrated in FIG. 2.
Figure 9:
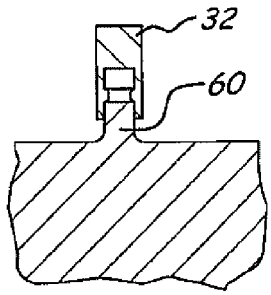
FIG. 9 is a detailed illustration of the flange element illustrated in FIG. 2, the detail illustrating an alternate weight attachment method.

In another embodiment, the circumferential feature 30 can comprise a flange element 60 (see FIG. 2). The flange element 60 is preferably formed around the perimeter surface 34 of the x-ray target element 18. The flange element 60, however, can be formed on a variety of surfaces including, but not limited to, the x-ray facing surface 36. The flange element 60 can include a plurality of mounting bores 62 formed around the flange element 60 (see FIG. 8). This allows the weight element(s) 32 to be mounted on the flange element 60 in any location around its circumference. It is contemplated that the weight elements 32 may be inserted into the mounting bores 62 as shown in FIG. 2 or may be directly mounted to the flange as shown in FIG. 9. Although the flange element 60 has been illustrated as being formed on the perimeter surface 34, it should be understood that the flange element 60 may be formed on any portion of the x-ray target element 18 to provide a range of balancing locations.

While particular embodiments of the invention have been shown and described, numerous variations and alternative embodiments will occur to those skilled in the art. Accordingly, it is intended that the invention be limited only in terms of the appended claims.

The invention claimed is:

1. An x-ray assembly comprising:

a target shaft;

an x-ray target element mounted to said target shaft; said x-ray target element comprising a central neck portion extending from an x-ray facing surface along an inner x-ray target diameter;

a plurality of circumferential features formed in said x-ray target element, one of said circumferential features formed onto said central neck portion; and at least one weight element configured to be securable in any of a plurality of positions within one of said circumferential features such that said x-ray target element is balanced around said target shaft.

2. An x-ray assembly comprising:

a target shaft;

an x-ray target element mounted to said target shaft;

a circumferential feature formed in said x-ray target element;

at least one weight element configured to be securable in a plurality of positions within said circumferential feature such that said x-ray target element is balanced around said target shaft, said circumferential feature comprising a flange element positioned around and protruding from a perimeter surface of said x-ray target element; and a plurality of mounting bores positioned along said flange element, said at least one weight element configured to be securable within any of said plurality of mounting bores.

3. An x-ray target assembly comprising:

an x-ray target element, said x-ray target clement comprising central neck portion extending from an x-ray facing surface along an inner x-ray target diameter;

a feature formed on said x-ray target element, said feature configured to receive a weight element, said feature formed onto said central neck portion; and at least one weight element configured to be securable in a plurality of positions on said feature such that said x-ray target element is balanced around a target shaft.

* * * * *